United States Patent [19]

Baus

[11] Patent Number: 4,606,084

[45] Date of Patent: Aug. 19, 1986

[54] SHOWER PARTITION

[76] Inventor: Heinz G. Baus, Wartbodenstrasse 35, CH-3626 Hünibach-Thun, Switzerland

[21] Appl. No.: 771,767

[22] Filed: Sep. 3, 1985

[30] Foreign Application Priority Data

Sep. 8, 1984 [DE] Fed. Rep. of Germany ..... 3433135

[51] Int. Cl.[4] ..... A47K 3/22; A47K 3/08

[52] U.S. Cl. ..... 4/607; 4/557; 4/610

[58] Field of Search ..... 4/607, 612, 608, 609–610, 4/557; 160/200

[56] References Cited

U.S. PATENT DOCUMENTS

| | | | |
|---|---|---|---|
| 1,582,881 | 4/1926 | Kraemer | 4/557 |
| 1,664,491 | 4/1928 | Siegel | 4/557 |
| 3,054,118 | 9/1962 | Bullock | 4/607 |
| 3,188,699 | 6/1965 | Walters | 4/607 X |
| 4,491,990 | 1/1985 | Robinson et al. | 4/607 |

FOREIGN PATENT DOCUMENTS

| | | |
|---|---|---|
| 7539749 | 12/1975 | Fed. Rep. of Germany . |
| 7921192 | 10/1979 | Fed. Rep. of Germany . |

*Primary Examiner*—Henry K. Artis

*Attorney, Agent, or Firm*—Schwartz, Jeffery, Schwaab, Mack, Blumenthal & Evans

[57] ABSTRACT

A shower partition includes a swinging door pivotable, by means of a hinge, about a substantially vertical axis. The installation dimensions available at the installation site often vary widely, discrepancies of up to 20 cm being by no means unusual. Compensation for tolerances or variations in installation dimensions is made possible in a simple manner. To this end, the swinging door is constructed so that it can be adjusted at right angles to its pivot axis on a jamb member or the like. The swinging door, and/or the pivot hinge comprise, at right angles to the pivot axis, a slot or a series of spaced aligned holes for an attachment element such as a screw.

13 Claims, 3 Drawing Figures

SHOWER PARTITION

BACKGROUND OF THE INVENTION

1. Field of the invention

The invention relates to a shower partition, for a shower stall, with a swinging door which, by means of a hinge, can pivot about a substantially vertical axis to close and open the stall entrance opening.

2. The Prior Art

German Utility Model No. 79 21 192 describes a shower stall comprising a double-panel door having a pivot bearing for each panel. In the vicinity of the entrance to the tub, the shower stall is of a predetermined width so that, to this extent, there are no special problems as regards tolerances and sealing in the entrance area. However, a not inconsiderable cost is involved in the production and assembly of the double panel door.

On the other hand, German Utility Model No. 75 39 749 describes a shower stall door which comprises, on the hinge-side, a hollow profile member. Arranged between a vertical door frame member and the hollow profile member, adapted to pivot with the swinging door, are sealing webs. Because of these sealing webs, adjustment of the door, and compensation for building tolerances are not immediately possible. This known shower partition comprises two swinging doors which are adapted to fold in relation to each other and contain a central stop flange and edge profile. Because of the often major differences in shower tub width and building tolerances, considerable difficulties arise during assembly of the shower partition. Additional compensating profiles or the like are required.

OBJECTS OF THE INVENTION

It is an object of the present invention to propose a shower partition which can be produced at low cost and which compensates in a simple manner for tolerances and differences in respective installation dimensions. It makes it possible to assemble the shower partition quickly and reliably, with no need for costly procedures such as cutting elongated profiled members to length, or for expensive tools, etc. The shower partition also ensures functional and reliable sealing of the entrance opening. It makes it further possible to assembly and fit the swinging door rapidly and with the necessary accuracy, even in the event of large on-site tolerances. It additionally makes it possible to install the door with few components, even with shower-tubs of different widths. A costly inventory, and the production of intermediate parts or the like, are avoided. For each adjustment, it is possible to obtain satisfactory sealing, not only on the hinge-side, but also at the other vertical edges of the swinging door.

In order to accomplish the above objects, it is proposed that the swinging door be so mounted as to adjustable at right angles to the axis of rotation, on a profiled rail or the like, the said swinging door, and/or the hinge, having, for the purposes of adjustment, a slot or a series of holes, spaced from each other, for an attachment element or elements.

The shower partition is of simple and inexpensive design, it being possible to adjust and fit the swinging door quite simply, according to the existing width of the tub entrance opening, in such a manner as to ensure a reliable and watertight closing of the entrance opening. The proposed construction of the shower partition makes it a simple matter to compensate for even major structural differences, in excess of 20 cm, in the said opening or in the width of the shower tub. This totally eliminates the need for special compensating profiled members or the like, such as are known to be used in the case of shower partition using sliding doors. On the other hand, such compensating profiles may also be provided, if necessary, for the purposes of vertical alignment. The slot, or the individual holes spaced from each other and aligned at right angles to the axis of rotation, may be provided at low production cost, in the swinging door, more particularly in one of the frame members thereof. This is preferably carried out by making one or more holes in the door or the frame member. It is essential in this connection that, according to the invention, the elongated hole, or also the individual holes, do not pass completely, but only partly through the frame member or the swinging door. If, for example, the frame member is in the form of a hollow profile having two spaced side or lateral walls parallel with each other and extending at right angles to the axis of rotation, then, according to the invention, only one lateral wall is provided with the slot or the individual holes. The range of adjustment is predetermined, quite simply, according to the length of the slot or the number of individual holes.

The disposition of the slot or the holes in the longitudinal direction of one of the frame members of the swinging door is also important. The slot has practically no effect upon the stability of the frame members of the door, and a secure connection is assured. The slot, or holes, is preferably provided in the horizontal frame members of the door. In this way it is not the width of the vertically frame members, but a not inconsiderable part of the overall length of the horizontal frame members that can be used for the adjusting range. In the case of the hitherto usual compensating profiled members, only the width thereof is available for adjustment, whereas, according to the invention, it is now possible to use whatever length of a profiled rail is required. If a continuous elongated hole or slot is provided for each hinge, infinite adjustment is possible over the whole range of adjustment. However, the invention also covers arrangements comprising, instead of a single elongated hole, or slot, a plurality of appropriately spaced individual holes, in order to achieve stepwise adjustment.

In one particular embodiment, an element is provided to cover the slot or holes. The size of the covering element is such that the slot is invisible to an observer, regardless of the adjustment thereof.

In one advantageous configuration, the swinging door is arranged in a plane at a predetermined distance from the axis of rotation of the hinge. During adjustment, the door can be moved past the axis of rotation and the bearing block, without restricting the amount of adjustment possible. It is particularly desirable to mount the swinging door, as seen in the direction of the shower tub, behind the hinge and/or behind the profiled jamb member which is secured to the wall of the building or the like. If the shower partition is adjusted to the smallest possible width then a part of the swinging door lies behind the vertical profiled jamb with the hinge. This part is not visible to an observer looking at the shower partition from the outside, since it is covered by the vertical profiled jamb. The shower partition therefore has practically the same appearance for any adjustment, regardless of width, and no parts of the door, or the like, look unsightly to an observer. Almost the whole width of the profiled jamb is therefore available for width-adjustment, a width-adjustment of up to 20 cm, preferably within a range of 10 cm, being thus available. Also advantageous is the arrangement of the axis of rotation of the hinge approximately in the same vertical plane as that the jamb member.

In one particular embodiment, in which the swinging door comprises frame members for a plastic panel or the like, the elongated hole or slot is formed in one of the frame members, more particularly in the upper and/or the lower horizontal frame members. The swinging door thus has a frame consisting, in known fashion, of four frame profiles arranged at right angles to each other, and it is a simple matter to provide for the elongated hole therein. Also significant is the arrangement of an elongated hole in the upper and lower horizontal frame member of the door, the said elongated hole running in the longitudinal direction of the frame member. The range of adjustment is thus not limited by the available width of the frame member. This provides simple but reliable attachment and, at the same time easy adjustability.

In one interesting embodiment, in order to provide simple and reliable adjustment, a clamping element is provided in a cavity of the swinging door or the frame member, running parallel with the elongated hole. Engaging with this clamping element is an attachment element associated with the bearing arm of the hinge, the said attachment element being preferably in the form of a screw matching the thread in the clamping element. When the swinging door is adjusted, there is relative movement of the clamping element in the cavity. The clamping element is not visible from the outside. Reliable attachment of the swinging door to the hinge, and to the bearing arm thereof, is obtained, and this takes up little room and is light.

In order to obtain, in a reliable manner, a simple evaluation of the vertical adjustment of the swinging door, the bearing block of the hinge comprises, on an extension directed vertically downwardly, a supporting surface bearing upon the upper edge of the shower tub. This is a simple way of ensuring definite vertical alignment of the door. Moreover, height adjustment may be carried out by the adjustment of bearing screws in the hinge. According to an embodiment of the invention, one, or preferably two, bearing screws are provided in the hinge, concentrically with the axis of rotation, the said screws being adjustable axially in a thread in the bearing arm or arms. Adjusting the bearing screws allows the door to be adjusted vertically. Provided on the underside of the swinging door is a sealing element, sealing in this area being ensured by the aforesaid vertical adjustment.

In a particularly interesting embodiment, the shower partition has only one swinging door which is adapted to swing outwardly, i.e. out of the shower tub. Access to the shower tub is therefore in no way impaired by the door, even under cramped conditions.

According to another embodiment, the bearing arm comprises a stop which extends inwardly in the direction of the swinging door. This prevents damage when the door is being closed. According to the invention, the bearing block, the stop and the previously mentioned extension are all in one piece. This reduces production costs, especially in the case of a component injection moulded out of plastic. This component is also connected to the vertical profiled jamb by means of which the swinging door is secured to a wall of the building or the like.

In order to ensure that the water runs away into the shower tub, the bottom of the swinging door may be provided, on the inside, with a water collecting channel or trough which slopes downwardly towards the axis of rotation. Thus, when the door is open, any splashes on the inside thereof can run down into the water collecting channel and thence into the shower tub. The water-collecting channel is of approximately U-shaped cross-section and it is secured to the lower horizontal frame member or edge of the door.

In order to provide for rapid and reliable attachment of the said water collecting channel, the swinging door, and/or the lower horizontal frame member, comprises a clamping gap into which one leg of the channel is inserted. Like the channel, the clamping gap extends over the whole width of the door, the lateral walls of the said gap, and/or of the leg, being provided with ribbing or the like. This configuration provides for reliable attachment of the said water collecting channel.

According to one particularly interesting embodiment, the swinging door, and/or the two hinges, preferably arranged at the top and bottom of the door, are designed in such a manner as to allow the door to be assembled to swing to the left or right. In other words, the swing door can be rotated, in its central plane, through 180°, during assembly, so that the hinges are located on the left-hand or the right-hand side. If a water collecting channel is fitted, the two vertical frame members of the swinging door comprise the necessary means of attachment and, more particularly, a clamping gap, into which the water collecting channel can be pushed.

In order to achieve reliable sealing along the vertical edge of the door facing the hinge, magnetic tape sealing may be provided in this area. This magnetic tape sealing can be relied upon to keep the door in the closed position. At the same time, it ensures sealing and prevents any spray from escaping. The magnetic tape is preferably arranged upon a stop member located upon a wall of the building or upon a stationary lateral wall of the shower partition. The door also has a magnetic tape along its vertical edge, but with opposite polarity, or it may have a magnetic return circuit part. Alternatively, of course, the magnetic return circuit part may be fitted to the stop member and the magnetic tape to the swinging door.

BROAD DESCRIPTION OF THE INVENTION

Thus, the invention, defined in broad terms, is a shower partition for a shower stall having an entrance opening. It comprises a shower door which swings between a closure position where the door stands across and closes the entrance opening and an open position where it is swung away from the entrance opening and frees it. The door has a general vertical plane and circumscribing edges. A jamb member having a vertical edge defines one side of the entrance opening, standing on one side of the door and extending along one of its circumscribing edges. Hinge means are provided to allow pivoting of the door between the aforesaid positions, the hinge means including a first hinge part on the vertical edge of the jamb member and a second hinge part on the one circumscribing edge, these hinge parts cooperating together to allow swinging of the door, between the aforesaid positions, about a vertical axis which lies away from the door plane. Means secure the second hinge part to the aforesaid circumscribing edge of the door and at one of a plurality of selectable locations disposed linearly transversely of the door plane, whereby to allow selectively locating the one circumscribing edge of the door with respect to the vertical edge of the jamb member by displacement of the door in its own plane.

A description now follows of a preferred embodiment of the invention having reference to the appended drawing wherein.

DESCRIPTION OF THE PREFERRED EMBODIMENT

Figure 1:
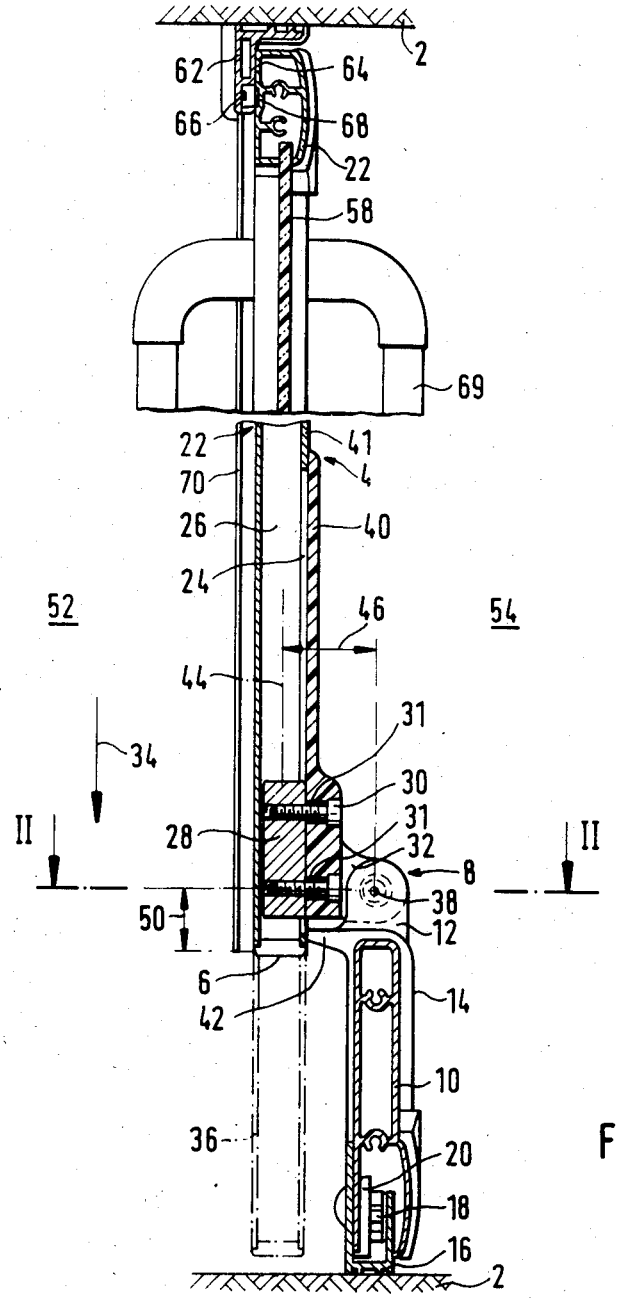
FIG. 1 is a horizontal cross-section through a shower partition made according to the invention and disposed between two walls of a building.

FIG. 1 shows a swinging door 4, having circumscribing edges, disposed between two walls 2 of a building, door 4 being secured, in the vicinity of a vertical edge 6 thereof, by means of a hinge 8, to a vertical profiled jamb member 10. Alternatively, one or two adequately known lateral walls may be associated with the shower partition, the said lateral walls running substantially at right angles to the swinging movement of the door; in this case, one or both of the building walls shown in the drawing are replaced, if necessary, by the said lateral walls. A bearing block 12 of the hinge 8 is also a part of a structural element 14 which is preferably made of plastic. The said component 14 is mounted at the lower end of profiled jamb member 10, to which it is attached in some suitable manner. Profiled jamb member 10 is connected to a compensating profile 16 which is bolted to wall 2 of the building. This connection, in this case, is effected by means of a screw 18 and of a clamping plate 20 which is arranged inside the compensating profile 16. Two or three such clamping plates 20, with screws 18, are provided over the entire vertical height of the profiled jamb member 10, appropriate horizontal slots being provided in the compensating profile 16 and/or in the profiled jamb member 10 so that the latter may easily be aligned vertically. Horizontal alignment, i.e. moving profiled jamb member 10 into or out of compensating profile 16, is also possible, but to a relatively limited extent only. In the vicinity of the upper and lower circumscribing edges of swinging door 4, the shower partition comprises hinges, only the lower hinge 8 being shown in the drawing, the upper hinge being designed accordingly.

Swinging door 4 includes a frame consisting of a total of four circumscribing edge members in the form of frame profiles, lower horizontal frame profile 22 being shown in cross-section in the drawing. The proposed swinging door, including its frame profiles and hinges, is designed in such a manner that it can open either to the right or to the left. The lower and upper horizontal edge member frame profiles are of the same design. Frame profile 22 is formed with an elongated hole or slot 24. Provided in a cavity 26 of the frame profile 22 is a clamping element 28 in which two attachment elements 30, such as screws, engage. Attachment elements 30 are introduced, from the outside, through holes 31 of the bearing arm 32 of the hinge 8 and through slot 24, and screwed into clamping element 28. Door 4 can be displaced horizontally in the direction of arrow 34, the other terminal position of the door 4 being shown by broken lines 36 in FIG. 1. Essential, in this connection, is the provision of door 4 in a plane parallel to and offset from the axis of rotation 38 of the hinge means 8, so that the door 4 may be displaced over practically the entire width of the profiled jamb member 10 and may be adjusted in the desired manner. In comparison with known compensating profiles, therefore, this provides a considerably larger range of adjustment for the door 4. Slot 24 is covered by an element 40 made solid with the hinge bearing arm 32. This provides an optimal configuration and is an easy way of preventing the penetration of dirt.

The hinge 8 is formed with holes 31, spaced at right angle to the axis of rotation 38, for the attachment elements 30, in this case in the form of screws. It may thus be seen that the swinging door 4, particularly the upper and lower frame profiles 22 thereof, may alternatively comprise correspondingly spaced individual holes instead of a single continuous elongated hole or slot such as 24. Although the latter provides infinite adjustment, suitable arrangement of a series of individual holes or passages makes it possible to obtain stepwise adjustability at right angles to axis of rotation 38. This may be an advantage if considerably stability is demanded. Elongated hole or slot 24, or the said individual holes, are provided only at one end 41 of the upper and lower horizontal edge frame profile 22 of the swinging door 4. The opposite end has no holes, which is an advantage from the point of view of stability of the door.

Component 14 forms a stop 42 which, as shown in FIG. 1, limits in a simple way, the angle of pivot of the swinging door 4. The component 14, the bearing block 12, the stop 42, and an extension still to be explained, are all made in one piece, thus ensuring inexpensive production. Swinging door 4 lies in a plane 44 which is at a predetermined distance 46 from the vertical plane containing the axis of rotation 38. This distance 46 is predetermined so that, in accordance with the broken outline door position 36, displacement and adjustment of the door 4 can be carried out behind the profiled jamb member 10 and the bearing block 12. Finally, it should be noted that, with each adjustment of the door, vertical edge 6 thereof is at an adequate distance 50 from the axis of rotation 38. It will be realized that this effectively prevents spray from escaping from the stall chamber 52 to the outside 54.

Provided upon wall 2 of the building remote from the hinge means 8 is a stop profiled member 62 against which the other vertical edge 64 of the swinging door 4 can be brought to rest. The stop member 62 is of approximately L-shaped cross-section and it includes a magnetic tape 66. Associated therewith, on the vertical frame profile edge member 22, is a magnetic return circuit part or another appropriate magnetic tape 68. This is a simple way of obtaining a magnetic seal which, at the same time, also holds the door 4 in the closed position shown. Door 4 also has, approximately centrally of its vertical height, a handle 69 shown only in part, which facilitates its opening and closing.

Figure 2:
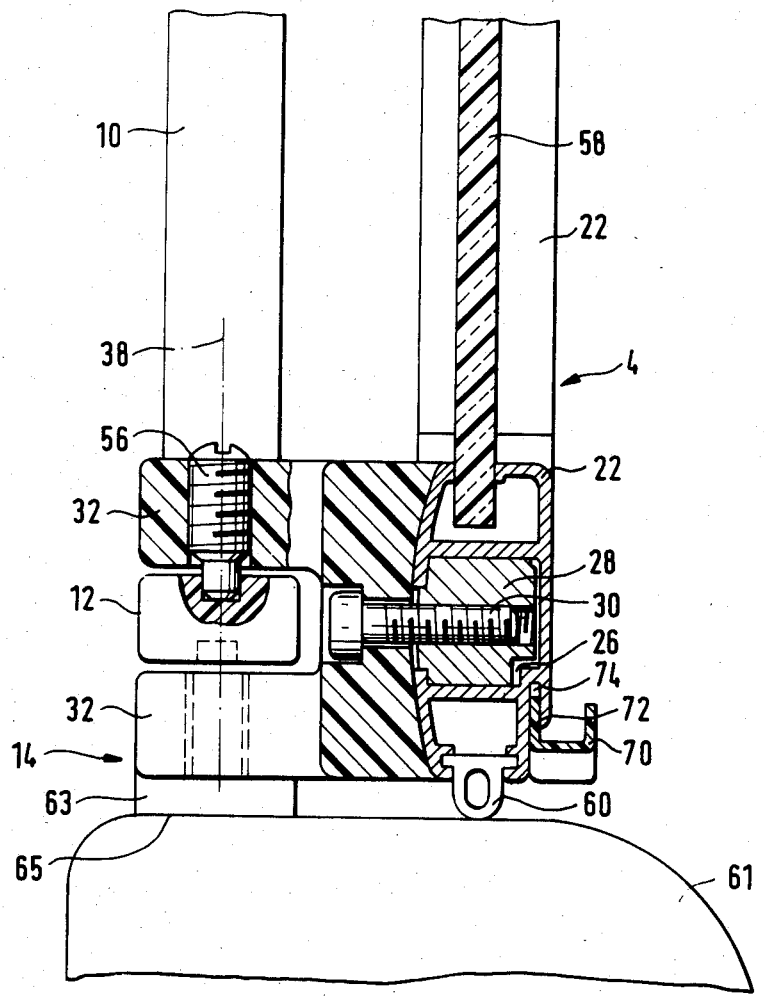
FIG. 2 is a cross-sectional view taken in a plane along line II—II of FIG. 1.

FIG. 2 shows a section along the line II—II in FIG. 1, only the lower part of the swinging door 4 being visible. Another like hinge means is provided at the upper end of profiled jamb member 10. Bearing block 12 engages between two bearing arms 32 spaced vertically apart and is attached thereto by means of bearing screws 56, in order to permit rotation about axis 38. Lower horizontal frame profile member 22 is in the form of a hollow section having an internal cavity 26 in which clamping element 28 is mounted. Both panel 58 of the door, preferably made of transparent plastic, and a further vertical edge frame profile may be seen. A sealing element 60 is provided, at the lower edge of door 4, in a longitudinal groove in horizontal frame profile member 22; sealing element 60 bearing upon the upper edge of the shower tube 61, shown here diagrammatically. Component 14 comprises a downward extension 63 provided with a supporting surface 65 at the bottom. The supporting surface 65 locates extension 63 upon the edge of the shower tub 61. In the case of the present shower tub, no additional profiled rails are necessary. Instead, swinging door 4 is located, according to the length of extension 63, with its lower edge at a small but specific distance from the upper edge of the shower tub. Sealing element 60 of the said door rests directly upon the upper edge of the shower tub. Arranged on the profiled frame member 22 is a U-shaped water collecting trough 70, leg 72 of the said trough being pushed into a clamping gap 74 in frame member 22 and being thus secured. The inner surfaces of clamping gap 74, and/or the surfaces of the leg 72, are ribbed, thus providing satisfactory attachment of the water collecting trough.

Figure 3:
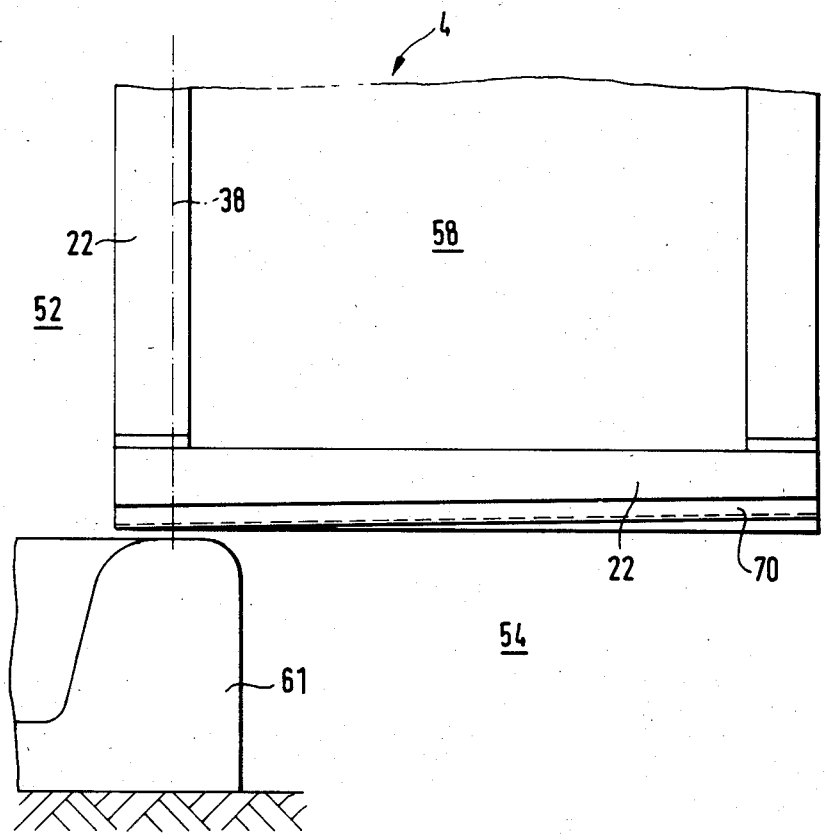
FIG. 3 is a highly diagrammatical representation of the swinging door in open position.

FIG. 3 is a diagrammatical representation of the swinging door 4 which has been pivoted to open position out of inner tub chamber 52, of the shower tub 61, into the outside 54. The water collecting trough 70 is arranged at the bottom of door 4, in lower horizontal frame member 22, the said trough sloping downwardly towards axis of rotation 38, i.e. towards inner tub chamber 52. Any water dripping on the door is therefore collected in the said trough and is simply returned to the inside of the shower tub 61.

I claim:

1. A shower partition for a shower stall having an entrance opening, said partition comprising:

a shower door swingable between a closure position where said door stands across and closes said entrance opening and an open position where said door is swung away from said entrance opening and frees said opening, said door extending in a general vertical plane and having circumscribing edges;

a jamb member having a vertical edge defining one side of said entrance opening, said jamb member standing on one side of said door and extending along one of said cricumscribing edges of said door;

at least one hinge means having a first hinge part on said vertical edge of said jam member and a second hinge part on said one of said circumscribing edges of said door, said hinge parts cooperating together to allow swinging of said door, between said positions, about a vertical axis lying away from said door plane, and means securing said second hinge part to said one of said circumscribing edges of said door and at one of a plurality of selectable locations disposed linearly transversely of said door plane, whereby to allow selectively locating said one circumscribing edge of said door with respect to said vertical edge of said jamb member by displacement of said door in said door plane.

2. A shower partition as claimed in claim 1, wherein said door is hollowed out at said one circumscribing edge to define a chamber between two outer spaced door walls, only one of said walls having a straight slot extending transversely horizontally of said door and perpendicularly of said vertical axis, said second hinge part securing means comprising:

a clamping element in said chamber, said clamping element having at least one engagement hole registering with said slot, and at least one securing element extending through said second hinge part and through said slot and releasably forcibly engaging into said engagement hole of said clamping element for pressing said one wall of said door against said second hinge part.

3. A shower partition as claimed in claim 1, wherein said door is hollowed out at said one circumscribing edge to define a chamber between two outer spaced door walls, one only of said walls having a series of through spaced holes disposed in a straight alignment extending transversely horizontally of said door and perpendicularly of said vertical axis, said second hinge part securing means comprising:

a clamping element in said chamber, said clamping element having at least one engagement hole registering with said slot, and at least one securing element extending through said second hinge part and one of said through holes and releasably forcibly engaging into said engagement hole of said clamping element for pressing said one wall of said door against said second hinge part.

4. A shower partition as claimed in claim 2, wherein said engagement hole is screw threaded and said securing means is a screw.

5. A shower partition as claimed in claim 3, wherein said engagement hole is screw threaded and said securing means is a screw.

6. A shower partition as claimed in claim 2, further comprising an arm extending from said second hinge part and covering said slot.

7. A shower partition as claimed in claim 3, further comprising an arm extending from said second hinge part and covering said through spaced aligned holes.

8. A shower partition as claimed in claim 1, wherein said general plane of said door is located at a distance from said vertical swing axis a predetermined distance suitable for allowing positioning of at least said one of said door circumscribing edges clear of said jamb member, when said door is closed.

9. A shower partition as claimed in claim 1, comprising two of said hinge means, one at the top and one at the bottom of said door and of said jamb member.

10. A shower partition as claimed in claim 1, wherein said jamb member is formed with a supporting surface at the bottom thereof for resting over an upper edge of a shower tub.

11. A shower partition as claimed in claim 1, wherein said one circumscribing edge of said door has a portion extending past said vertical swing axis in parallel spaced relationship with said jamb member when said door is closed, further comprising a stop member projecting from said jamb member in the direction of said door edge portion for stopping said door in said closure position.

12. A shower partition as claimed in claim 1, further comprising a water collecting trough and means securing said trough in inclined position at the bottom one of said circumscribing edges of said door and on the side thereof corresponding to the inside of a shower tub.

13. A shower partition as claimed in claim 1, further comprising a second jamb member having an L-shaped member extending lengthwise thereof with an arm projecting toward said door to serve as a stop member therefor in said closure position of said door, and magnetic means on said arm and on an adjoining one of said door circumscribing edges for holding said door in said closure position.

* * * * *